United States Patent [19]

Seehofer et al.

[11] 4,182,348

[45] Jan. 8, 1980

[54] REMOVAL OF NITRIC OXIDE AND CARBON MONOXIDE FROM TOBACCO SMOKE

[75] Inventors: Friedlieb Seehofer, Pinneberg; Erwin Kausch, Buchholz, both of Fed. Rep. of Germany

[73] Assignee: B.A.T. Cigaretten-Fabriken GmbH, Hamburg, Fed. Rep. of Germany

[21] Appl. No.: 938,004

[22] Filed: Aug. 30, 1978

[30] Foreign Application Priority Data

Sep. 6, 1977 [DE] Fed. Rep. of Germany ..... 2740011

[51] Int. Cl.[2] ..... A24B 15/00; B01D 53/34; A24B 15/027

[52] U.S. Cl. ..... 131/10 R; 131/10.7; 131/10.9; 131/15 R; 131/17 R; 131/140 R; 131/261 R; 131/264

[58] Field of Search ..... 131/9, 10 R, 10.7, 10.9, 131/15 R, 15 A, 15 C, 17 R, 140 R, 17 A, 140 C, 261 R, 264, 265; 423/213.5, 213.7, 239; 252/466, 466 B, 472, 470, 474, 462, 473, 466 PT, 468, 464, 465, 469

[56] References Cited

U.S. PATENT DOCUMENTS

| | | | |
|---|---|---|---|
| 3,907,968 | 9/1975 | Kobylinski et al. | 423/213.5 |
| 4,089,810 | 5/1978 | Diwell et al. | 423/213.5 |

*Primary Examiner*—V. Millin

*Attorney, Agent, or Firm*—Bierman & Bierman

[57] ABSTRACT

A method for the catalytic removal of nitric oxide and carbon monoxide from tobacco smoke which comprises contacting the smoke with a compound of the formula $$M_2M'RuO_6$$

wherein M is a divalent metal, M′ is a trivalent rare earth metal, and Ru has a valence of 5, M and M′ being such that their ions are capable of forming a perovskite lattice with the Ru ions. The catalyst can be mixed with tobacco, or incorporated into the cigarette paper or filter. Optionally, suitable inorganic or organic adsorbing materials are desirable; e.g. carbon and calcium carbonate.

13 Claims, No Drawings

REMOVAL OF NITRIC OXIDE AND CARBON MONOXIDE FROM TOBACCO SMOKE

This application claims the priority of German application P 27 40 011.9, filed Sept. 6, 1977.

The present invention is directed to the removal of certain undesirable gases from tobacco smoke, more particularly to the catalytic elimination of nitric oxide and carbon monoxide to minimize the noxious effects of smoking.

It has been previously recognized that ruthenium can lower the carbon monoxide and nitric oxide content of waste gases from internal combustion engines. Ruthenium has been found effective in this regard when used as such or as part of a catalyst containing ruthenium compounds. Such materials selectively favor the following reactions:

$$2CO+O_2 \rightarrow 2CO_2$$

$$2CO+2NO \rightarrow 2CO_2+N_2$$

Such catalysts are totally unsuitable for use in connection with cigarettes because of the formation of the physiologically hazardous and volatile $RuO_4$. As a result of this disadvantage, ruthenium catalysts had never been used to alter the composition of tobacco smoke. It has now been found that ruthenium compounds having a perovskite structure will assist in the lowering of the carbon monoxide and nitric oxide content of tobacco smoke without the formation of $RuO_4$. Such compounds, according to the present invention, comprise catalysts of the formula $$M_2M'RuO_6$$

M is a divalent metal, M' is a trivalent rare earth metal, and Ru has a valence of 5. The metals are such that there ions are capable of forming a perovskite lattice with the rubidium ions. Especially suitable for M are strontium and barium. Similarly, the preferred M' metals are yttrium and lanthanum. In particular, $Ba_2LaRuO_6$ is especially useful for this purpose.

The catalyst of the present invention can be mixed with the tobacco itself, placed in the filter material, or made a part of the cigarette paper. Suitable organic or inorganic adsorbent materials may be used if desired. In the case of multi-chamber filters, it is possible to place the catalyst in one chamber with or without the adsorbent material.

The adsorbent material can be active carbon, calcium carbonate (dolomite), vegetable flours, and other suitable adsorbing substances, preferably in powder form. Starch has been found to be particularly suitable. When the catalyst is mixed with the tobacco or cigarette paper, it is necessary to limit the use of adsorbent materials to those which will withstand combustion without the generation of undesirable, noxious products. Calcium carbonate and silicon dioxide have been found particularly suitable for this purpose.

An especially preferred composition in accordance with the present invention, comprises 10 mg of $Ba_2LaRuO_6$ mixed with 150 to 200 mg of calcium carbonate as the filling for a chamber of a multi-chambered filter. Especially desirable is a 3-chambered filter.

EXAMPLE 1

$Ba_2LaRuO_6$ was used as the catalyst of the present invention. 10 mg of the catalyst were placed in one chamber of a 3-chambered filter on an "American-Blend" cigarette. Along with the catalyst, was placed 100 mg of active carbon as a carrier.

The cigarettes were smoked completely and the nitric oxide (as $NO_2$) and carbon monoxide were determined by means of Drager tubes, all in accordance with DIN 10240. As a control, a corresponding cigarette having no filter whatsoever was also tested.

In addition, the test was repeated on the filter cigarettes using 100 mg of catalyst. All other conditions remained the same.

The results of the tests are set forth in the following table:

| | | Cigarette (unfiltered) | Filter Cigarettes 10 mg | Filter Cigarettes 100 mg |
|---|---|---|---|---|
| Chamber filter + carbon | CO (Vol. %) | 4.6 | 3.9 | 2.6 |
| | NO (ppm) | 950 | 605 | 254 |

EXAMPLE 2

The procedure set forth in Example 1 was followed except that the carrier was calcium carbonate (dolomite). The results obtained were substantially the same as those set forth in Example 1.

EXAMPLE 3

The method of Example 1 was followed except that a double filter of paper and cellulose acetate was used and the catalyst was impregnated into the paper portion by sprinkling. The results were also similar to those of Example 1.

EXAMPLE 4

This test was carried out in the same manner as Example 1, except that the catalyst was sprinkled directly onto the tobacco fiber. Here, too, the results were similar to those set forth in Example 1.

Although only a limited number of Examples have been specifically disclosed, the invention is, nonetheless, to be broadly construed and not to be limited except by the character of the claims appended hereto.

What we claim is:

1. A method for the catalytic removal of nitric oxide and carbon monoxide from tobacco smoke which comprises contacting said smoke with a compound of the formula $$M_2M'RuO_6$$

wherein M is a divalent metal, M' is a trivalent rare earth metal, and Ru has a valence of 5, M and M' being such that their ions are capable of forming a perovskite lattice with the Ru ions.

2. A method according to claim 1 wherein M is taken from the class consisting of strontium and barium.

3. A method according to claim 1 wherein M' is taken from the class consisting of yttrium and lanthanum.

4. A method according to claim 3 wherein M is taken from the class consisting of strontium and barium.

5. A method according to claim 1 wherein said compound is $Ba_2LaRuO_6$.

6. A method according to claim 1 wherein said compound is added to tobacco, filter means for a cigarette, or cigarette paper.

7. A method according to claim 6 wherein at least 10 mg of said compound are used per gram of said tobacco, filter means, or cigarette paper.

8. A method according to claim 1 wherein an adsorbant is also present.

9. A tobacco smoke filter comprising the compound of claim 1 and from 0 to an effective amount of an adsorbant.

10. A filter according to claim 9 comprising at least two sections, one section containing said compound.

11. A filter according to claim 9 containing 5 to 200 mg of said compound.

12. A filter according to claim 9 containing 10 to 100 mg of said compound.

13. A cigarette paper comprising the compound of claim 1 and from 0 to an effective amount of an adsorbant.

* * * * *